US011141871B2

(12) United States Patent
Paauw et al.

(10) Patent No.: US 11,141,871 B2
(45) Date of Patent: Oct. 12, 2021

(54) HAIR GUIDE FOR HAIR CUTTING APPARATUS

(71) Applicant: KONINKLIJKE PHILIPS N.V., Eindhoven (NL)

(72) Inventors: Hendrik Klaas Paauw, Roden (NL); Luca Iaccarino, Groningen (NL); Michael Reece Jenkins, Amsterdam (NL)

(73) Assignee: Koninklijke Philips N.V., Eindhoven (NL)

( * ) Notice: Subject to any disclaimer, the term of this patent is extended or adjusted under 35 U.S.C. 154(b) by 6 days.

(21) Appl. No.: 16/629,613

(22) PCT Filed: Jul. 2, 2018

(86) PCT No.: PCT/EP2018/067742
§ 371 (c)(1),
(2) Date: Jan. 9, 2020

(87) PCT Pub. No.: WO2019/011685
PCT Pub. Date: Jan. 17, 2019

(65) Prior Publication Data

US 2021/0146559 A1 May 20, 2021

(30) Foreign Application Priority Data

Jul. 11, 2017 (EP) ..... 17180743

(51) Int. Cl.
*B26B 19/14* (2006.01)
*B26B 19/38* (2006.01)

(52) U.S. Cl.
CPC ..... *B26B 19/143* (2013.01); *B26B 19/3813* (2013.01)

(58) Field of Classification Search
CPC ..... B26B 19/205; B26B 19/20; B26B 19/384; B26B 19/143; B26B 19/145; B26B 19/28;
(Continued)

(56) References Cited

U.S. PATENT DOCUMENTS 2,932,891 A * 4/1960 Waggoner ..... B26B 19/3813 30/537
3,008,233 A * 11/1961 Waggoner ..... B26B 19/3813 30/537
(Continued)

FOREIGN PATENT DOCUMENTS

CN 1169351 1/1998
CN 202227139 5/2012
(Continued)

OTHER PUBLICATIONS

International Search Report and Written Opinion dated Sep. 28, 2018 for International Application No. PCT/EP2018/067742 filed Jul. 2, 2018.

*Primary Examiner* — Ghassem Alie

(57) ABSTRACT

A hair guide including a support member detachably couplable to a hair cutting apparatus, and at least two annular hair guiding members each having a central axis and hair guiding elements extending radially relative to the central axis and arranged in an annular hair guiding zone. At least one hair guiding element has an inwardly directed rounded end portion arranged at a distance from the central axis such that, when the support member is coupled to the hair cutting apparatus, the rounded end portion is positioned, in a radial direction relative to the central axis, at least partially inwardly of an inner side wall of an annular cutting zone of an associated cutting unit of the hair cutting apparatus and, in an axial direction relative to the central axis, at a distance from an annular recessed area of a central wall portion of the associated cutting unit.

12 Claims, 4 Drawing Sheets

(58) Field of Classification Search
CPC ..... B26B 21/42; B26B 21/02; B26B 19/042; B26B 19/046; B26B 19/063; B26B 19/14; B26B 19/38; B26B 19/3846; B26B 19/3813; B21B 19/04
USPC ... 30/50, 41, 34.6, 346.51, 34.05, 41.7, 537, 30/538; D28/44, 50
See application file for complete search history.

(56) References Cited

U.S. PATENT DOCUMENTS

| | | | | |
|---|---|---|---|---|
| 3,107,423 | A * | 10/1963 | Caesar | B26B 19/20 30/537 |
| 3,109,236 | A * | 11/1963 | Wolf | B26B 19/3813 30/537 |
| 4,003,390 | A | 1/1977 | Solie | |
| 4,888,870 | A | 12/1989 | Fujikawa | |
| 5,621,971 | A | 4/1997 | Szymansky | |
| 10,213,930 | B2 * | 2/2019 | Bady | B26B 19/042 |
| 2008/0040935 | A1 * | 2/2008 | Gratz | B26B 19/3813 30/539 |
| 2015/0040403 | A1 | 2/2015 | Campbell | |
| 2017/0190063 | A1 | 7/2017 | Schratter | |

FOREIGN PATENT DOCUMENTS

| | | |
|---|---|---|
| CN | 202264244 | 6/2012 |
| CN | 102733134 | 10/2012 |
| EP | 2481535 | 8/2012 |
| EP | 3037224 | 6/2016 |
| EP | 3103599 | 12/2016 |
| GB | 2207879 | 2/1989 |
| GB | 2209986 | 6/1989 |
| JP | S57166570 | 10/1982 |
| JP | H01212588 | 8/1989 |
| KR | 200466246 | 4/2013 |
| WO | 2016/041959 | 3/2016 |

* cited by examiner

HAIR GUIDE FOR HAIR CUTTING APPARATUS

CROSS REFERENCE TO RELATED APPLICATIONS

This application is the U.S. National Phase application under 35 U.S.C. § 371 of International Application No. PCT/EP2018/067742 filed Jul. 2, 2018, published as WO 2019/011685 on Jan. 17, 2019, which claims the benefit of European Patent Application Number 171780743.1 filed Jul. 11, 2017. These applications are hereby incorporated by reference herein.

TECHNICAL FIELD OF THE INVENTION

The present invention relates generally to a hair guide for a hair cutting apparatus.

BACKGROUND OF THE INVENTION

Electric hair cutting devices are widely used to cut body hair and typically include a handle and a cutting head. Rotary cutters are known which comprise an outer cutting member and an inner cutting member which rotates with respect to the outer cutting member so as to perform a cutting operation. In some arrangements the outer cutting member may comprise a plurality of hair-entry openings, and the inner cutting member may comprise a plurality of sharpened elements which cut hairs which extend into the hair-entry openings.

In order to guide hairs into the hair-entry openings to be cut, a hair guide may be provided. The hair guide may be arranged so as to manipulate hairs towards the hair-entry openings as the cutting head is moved across the user's skin.

Such hair guides may also control a length of the hair to remain after cutting. In some examples, the outer surface of the hair guide is spaced away from the outer surface of the cutting head by a pre-set distance, such that hairs which are shorter than the pre-set distance are not cut, and hairs which are longer than the pre-set distance are cut to be no shorter than the pre-set distance. Examples of such hair guides are disclosed in EP 2481535 A1, where additional grids of varying thickness are mountable upon a basic grid of the cutting head to cut hairs at a predefined distance from the skin.

However, hair guides of this type can also obstruct access of hairs to the cutting members of the apparatus, thereby reducing cutting efficiency, increasing the time needed for hair cutting and increasing skin irritation caused by hair cutting.

GB 2 207 879 A discloses a hair trimmer including a cutting head having an outer shearing foil cooperating with an inner cutter. The cutting head comprises a hair guide surface on its top and a skin engaging comb. A number of hair introducing perforations are formed in a portion of the outer shearing foil which is located below the hair guide surface and inclined thereto. In an embodiment, the skin engaging comb includes a plurality of upright bristles and a plurality of oblique comb teeth, which extend from a support ring and are circumferentially spaced therealong. The comb teeth project over the inclined portion of the outer shearing foil up to a point above the hair guide surface in an oblique relation to the inclined portion of the outer shearing foil for combing hair strands on the hair guide surface in cooperation with the upright bristles.

SUMMARY OF THE INVENTION

Therefore, it will be understood that improvements may be desirable in the field of hair guides for hair cutting apparatus.

According to an aspect of the present invention, there is provided a hair guide configured to be detachably couplable to a hair cutting apparatus, wherein the hair cutting apparatus comprises at least two cutting units each having an external cutting member and an internal cutting member which is rotatable relative to the external cutting member about an axis of rotation, wherein the external cutting member has an annular cutting zone comprising hair-entry openings provided at least in a main annular wall of the cutting zone, said annular cutting zone further comprising an inner side wall which surrounds a central wall portion of the external cutting member, said central wall portion being recessed relative to the main annular wall at least in an annular recessed area adjacent to the inner side wall, said hair guide comprising a support member configured to be detachably couplable to the hair cutting apparatus, and at least two annular hair guiding members each having a central axis and a plurality of hair guiding elements having a main direction of extension in a radial direction relative to the central axis and arranged in an annular hair guiding zone extending about the central axis, wherein the annular hair guiding members are arranged relative to the support member such that, when the support member is coupled to the hair cutting apparatus, each of the at least two annular hair guiding members is associated with a respective one of the at least two cutting units such that the plurality of hair guiding elements partially cover the main annular wall of the associated cutting unit, and wherein at least one of the hair guiding elements has an inwardly directed rounded end portion which is arranged at a distance from the central axis such that, when the support member is coupled to the hair cutting apparatus, the rounded end portion is positioned, in a radial direction relative to the central axis, at least partially inwardly of the inner side wall of the associated cutting unit and, in an axial direction relative to the central axis, at a distance from the annular recessed area of the associated cutting unit. The hair cutting apparatus may comprise three cutting units and the hair guide may comprise three hair guiding members.

In an embodiment of the hair guide according to the invention, each of the plurality of hair guiding elements has an inwardly directed rounded end portion which is arranged at a distance from the central axis such that, when the support member is coupled to the hair cutting apparatus, the rounded end portion is positioned, in a radial direction relative to the central axis, at least partially inwardly of the inner side wall of the associated cutting unit and, in an axial direction relative to the central axis, at a distance from the annular recessed area of the associated cutting unit.

In a further embodiment of the hair guide according to the invention, the rounded end portions of the hair guiding elements comprise a part-spherical portion. In a further embodiment of the hair guide according to the invention, the rounded end portions of the hair guiding elements are each arranged at an equal distance from the central axis.

In a preferred embodiment of the hair guide according to the invention, the annular cutting zone of the associated cutting unit further comprises an outer side wall which surrounds the main annular wall of the associated cutting unit, and each annular hair guiding member is arranged relative to the support member such that, when the support member is coupled to the hair cutting apparatus, the plurality of hair guiding elements partially cover the outer side wall.

In an embodiment of the hair guide according to the invention, the hair guiding elements are configured such that, when the support member is coupled to the hair cutting apparatus, a lower surface of each hair guiding element is in contact with the main annular wall of the associated cutting unit.

In a further embodiment of the hair guide according to the invention, the hair guiding elements are configured such that, when the support member is coupled to the hair cutting apparatus, the lower surface of each hair guiding element is in contact with the main annular wall of the associated cutting unit over a majority of a radial extension of the main annular wall relative to the axis of rotation.

In a preferred embodiment of the hair guide according to the invention, the hair-entry openings of the associated cutting unit have a main direction of extension in a radial direction relative to the axis of rotation, and the hair guiding elements are configured such that, when the support member is coupled to the hair cutting apparatus, the main direction of extension of each hair guiding element is parallel to the main direction of extension of a hair-entry opening adjacent to the respective hair guiding element.

In a further embodiment of the hair guide according to the invention, the hair guiding elements are arranged in the annular hair guiding zone with an equal distance between each pair of adjacent hair guiding elements.

In a yet further embodiment of the hair guide according to the invention, the hair guiding elements each have an equal shape and equal dimensions.

In a preferred embodiment of the hair guide according to the invention, each annular hair guiding member is arranged relative to the support member such that, when the support member is coupled to the hair cutting apparatus, the central axis coincides with the axis of rotation of the associated cutting unit.

In a yet further embodiment of the hair guide according to the invention, the support member comprises a coupling member configured and arranged to be detachably engaged with an associated coupling member of the hair cutting apparatus.

At the location of the annular cutting zone of the external cutting member when the hair guide is coupled to the hair cutting apparatus, the hair guiding elements may have a depth in an axial direction relative to the central axis corresponding to a minimum length of hair after cutting.

The hair guide may be rotationally symmetrical such that it can be attached to the hair cutting apparatus in a plurality of orientations.

According to a further aspect of the present invention, there is provided a hair cutting system comprising a hair cutting apparatus and a hair guide, wherein the hair cutting apparatus comprises at least two cutting units each having an external cutting member and an internal cutting member which is rotatable relative to the external cutting member about an axis of rotation, wherein the external cutting member has an annular cutting zone comprising hair-entry openings provided at least in a main annular wall of the cutting zone, said annular cutting zone further comprising an inner side wall which surrounds a central wall portion of the external cutting member, said central wall portion being recessed relative to the main annular wall at least in an annular recessed area adjacent to the inner side wall, and wherein the hair guide is a hair guide according to the invention as herein described.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE PREFERRED EMBODIMENTS

Figure 1:
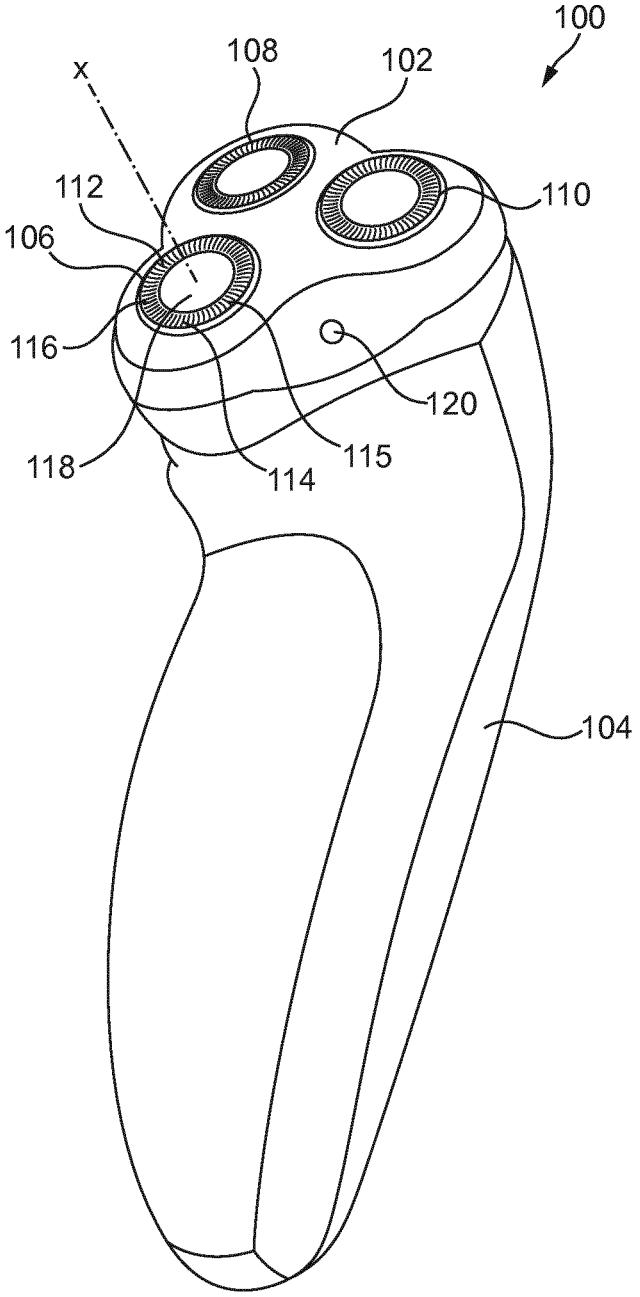
FIG. 1 schematically shows a hair cutting apparatus onto which a hair guide according to the invention may be attached.

FIG. 1 generally shows a hair cutting apparatus 1, in the form of an electric rotary shaver. The hair cutting apparatus 1 comprises a cutting head 102 attached to a main body or handle 104. In some arrangements, the cutting head 102 may be pivotable with respect to the handle 104.

The cutting head 102 comprises first, second, and third cutting units 106, 108, 110, in the form of rotary cutters. The cutting units 106, 108, 110 are arranged on an upper face of the cutting head 102 in a substantially triangular arrangement. In some arrangements, the cutting units 106, 108, 110 may be pivotable relative to a frame of the cutting head 102 or otherwise moveable relative to one another in order to better conform to a user's face during shaving.

Each cutting unit 106, 108, 110 is substantially identical in form and function and so only one of the cutting units 106 will be described in detail and this description should be equally applicable to the other two cutting units 108, 110.

The cutting unit 106 comprises an external cutting member 112. An internal cutting member (not shown) is arranged beneath the external cutting member 112. The internal cutting member is rotatable relative to the external cutting member about a central axis of rotation x. The internal cutting member can be driven into rotation by an electric motor (not shown) accommodated in the handle 104. The external cutting member 112 further comprises an annular cutting zone 114.

The annular cutting zone 114 comprises a main annular wall 115 wherein a plurality of hair-entry openings 116 is provided. The hair-entry openings 116 permit hairs to extend into the cutting unit 106 in order to be cut between cutting edges of the openings 116 and cutting edges of the rotating internal cutting member. In the present embodiment, the hair-entry openings 116 extend mainly in a radial extension direction from an outer edge of the main annular wall 115 to an inner edge of the main annular wall 115. The hair-entry openings 116 are also curved or ached along their main extension direction, although, in other arrangements, the hair-entry openings 116 may be linear.

The cutting units 106, 108, 110 will be described in more detail below with reference to FIG. 4.

The hair cutting apparatus 100 also comprises a coupling member 120 for coupling or engaging with a coupling member of a hair guide.

Figure 2:
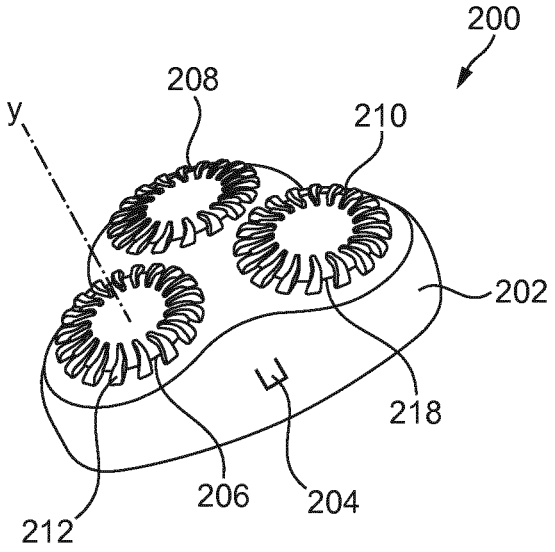
FIG. 2 schematically shows a hair guide according to the invention.

FIG. 2 shows a hair guide 200 for use with the hair cutting apparatus 100. The hair guide 200 comprises a support member 202 in the form of a main body of the hair guide 200. An inner surface of support member 202 substantially conforms to the shape of the external surface of the cutting head 102 of the hair cutting apparatus 100. The support member 202 comprises a coupling member 204 for detachable engagement with the coupling member 120 of the hair cutting apparatus 100 to retain the hair guide 200 in place on the apparatus 100. In this way, the hair guide 200 is configured to be detachably couplable to the cutting head 102 of the hair cutting apparatus 100, so that a user can use the hair cutting apparatus either without the hair guide 200 being coupled to the cutting head 102 or with the hair guide 200 being coupled to the cutting head 102. The coupling members 120, 204 are not shown in detail, but they may be of any suitable form as known to the person skilled in the art, for example in a form providing a snap connection.

The hair guide 200 further comprises three annular hair guiding members, 206, 208, 210. Each of the annular hair guiding members 206, 208, 210 is arranged for co-operation with a respective one of the cutting units 106, 108, 110 when the hair guide 200 is coupled to the cutting head 102. The three annular hair guiding members 206, 208, 210 are substantially identical, so only one of the annular hair guiding members 206 will be described in detail.

The annular hair guiding member 206 has a central axis y which coincides with the central axis of rotation x of the cutting unit 106 when the hair guide 200 is coupled to the hair cutting apparatus 100. The annular hair guiding member 206 further comprises a plurality of hair guiding elements 212 arranged circumferentially about a circular aperture 218 with equal spacing therebetween.

The hair guiding elements 212 are arranged in an annular hair guiding zone 214 extending about the central axis y, and each have a main direction of extension in a radial direction relative to the central axis y. In the present embodiment, the hair guiding elements 212 each extend parallel to the main direction of extension of a hair-entry opening 116 which is adjacent to the respective hair guiding element 212 when the hair guide 200 is coupled to the cutting head 102. For example, where the hair-entry openings 116 are linear slots, the hair guiding elements 212 may extend linearly. Alternatively, where the hair-entry openings 116 are arcuate slots, the hair guiding elements 212 may also be arcuate in order to follow the shape of the adjacent hair-entry openings 116 in the radial direction.

Figure 3:
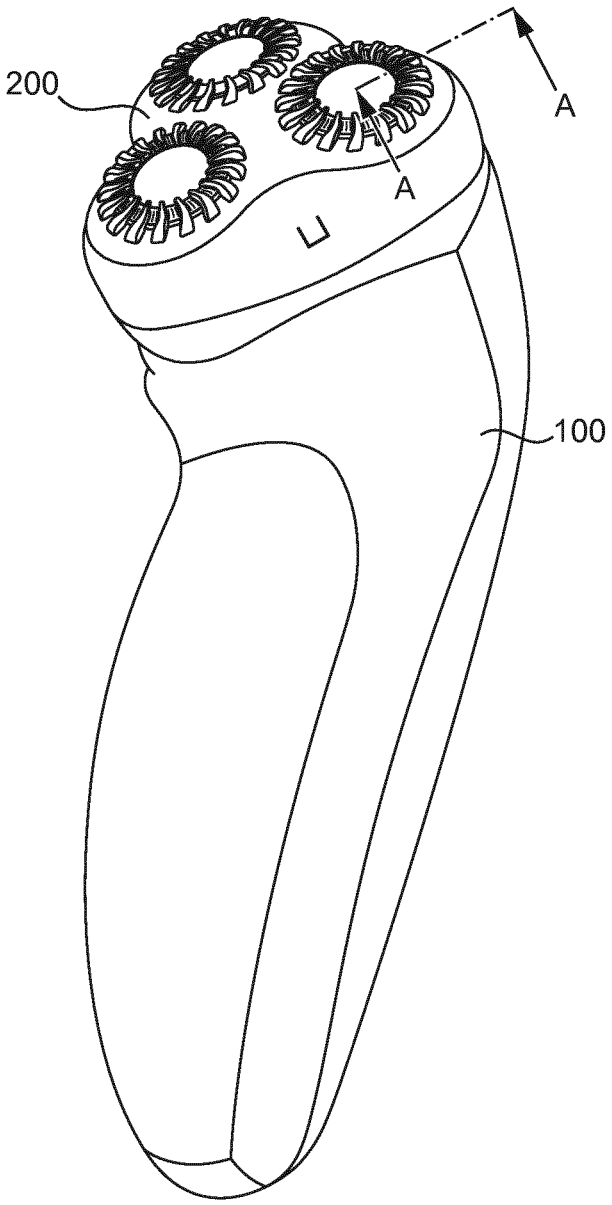
FIG. 3 schematically shows the hair guide of FIG. 2 when attached to the hair cutting apparatus of FIG. 1, thereby forming a hair cutting system according to the invention.

As shown in FIG. 3, the hair guide 200 is attachable to the hair cutting apparatus 100 over the cutting head 102 such that the annular hair guiding members 206, 208, 210 of the hair guide 200 align with the cutting units 106, 108, 110 of the cutting head 102. In use, the presence of the annular hair guiding members 206, 208, 210 on top of the annular cutting zones 114 of the cutting units 106, 108, 110 increases the distance between the skin and the internal cutting members of the cutting units 106, 108, 110 so that, after being cut, the remaining hairs will have a longer length as compared to hairs that are cut by the cutting units 106, 108, 110 without the use of the hair guide 200. Thus, without the use of the hair guide 200, the hair cutting apparatus 100 has a regular shaving function and, with the use of the hair guide 200, the hair cutting apparatus 100 has a hair trimming function. The hair guide 200 also functions to better guide hairs into the hair entry openings 116 of the cutting units 106, 108, 110 to improve hair cutting. As the support member 202 substantially conforms to the shape of the cutting head 102 when the coupling members 120, 204 engage, the hair guide 200 is securely located on the hair cutting apparatus 100 for use during trimming.

In some arrangements, the hair guide 200 and the cutting head 102 may be rotationally symmetrical such that the hair guide 200 can be attached to the cutting head 102 in a plurality of orientations while maintaining the same functionality.

The co-operation of the hair guide 200 with the cutting head 102 will now be described in more detail with reference to FIG. 4. FIG. 4 shows a cross-sectional view of a cutting unit of the hair cutting apparatus 100 and hair guide 200 along the line A-A shown in FIG. 3. More generally, FIG. 4 shows a radially extending cross section of the annular cutting zone 114 of the cutting unit 106 of the cutting head 102 and the annular hair guiding zone 214 of the annular hair guiding member 206 of the hair guide 200 when the hair guide 200 is coupled to the cutting head 102.

Figure 4:
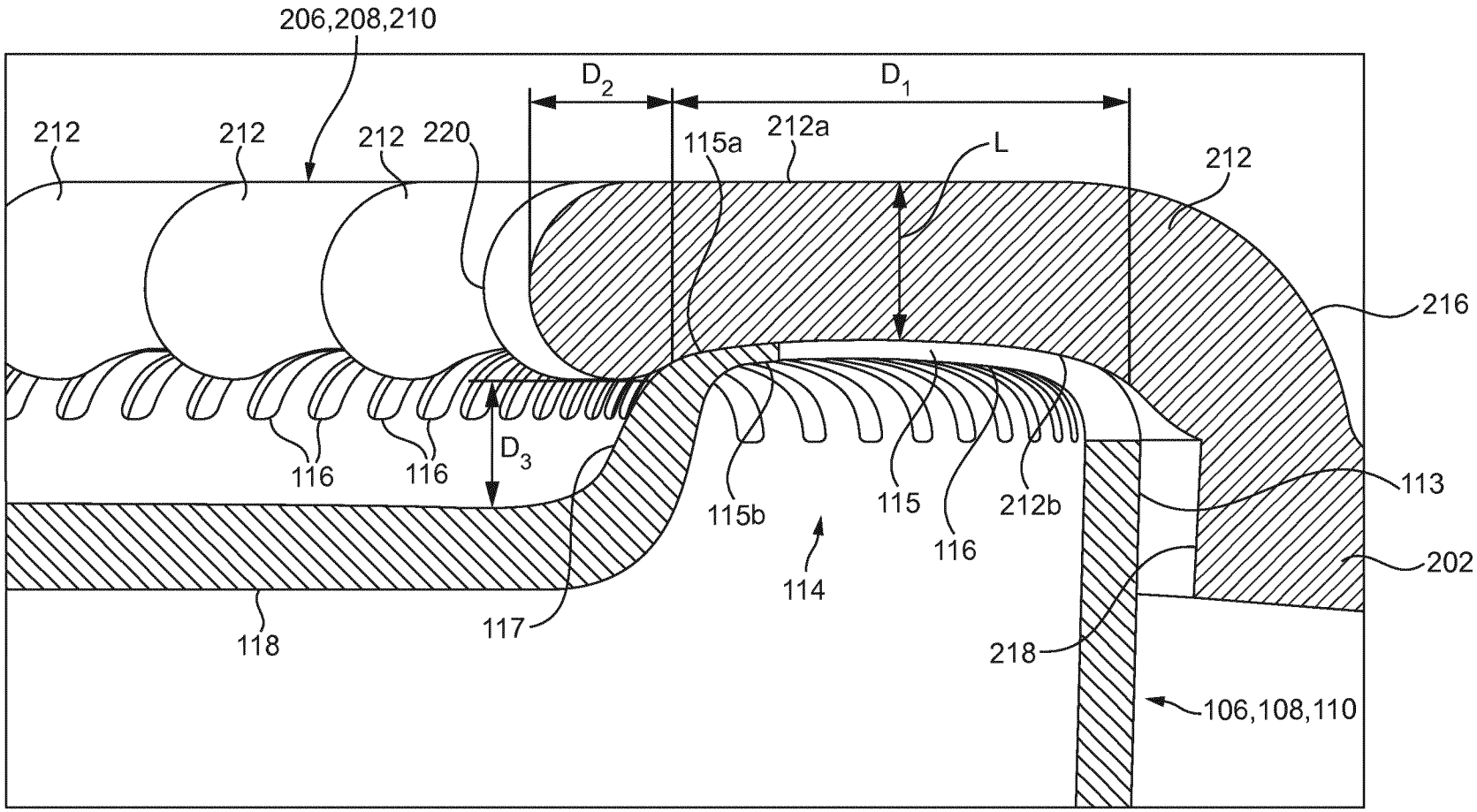
FIG. 4 schematically shows a cross-sectional view of a cutting unit of the hair cutting apparatus and the hair guide of FIG. 3, taken along the line A-A in FIG. 3.

As can be seen more clearly in FIG. 4, the annular cutting zone 114 of the external cutting member 112 comprises an inner side wall 117, which surrounds a central wall portion 118 of the external cutting member 112, and an outer side wall 113 which surrounds the main annular wall 115 of the annular cutting zone 114. The inner side wall 117 extends relative to the central axis of rotation x partially radially inward and partially axially towards the cutting head 102 such that the central wall portion 118 is recessed relative to the main annular wall 115. Thus, the inner side wall 117 forms a stepped or sloped transition between the main annular wall 115 and the central wall portion 118. The area of the central wall portion 118 adjacent the inner side wall 117 may therefore be referred to as an annular recessed area of the cutting unit 106. This annular recessed area will be understood to be recessed from the main annular wall 115 by the length of the inner side wall 117 in the axial direction of the central axis of rotation x. The outer side wall 113 is surrounded by the support member 202 and the hair guiding elements 212 of the hair guide 200.

In some arrangements, the central wall portion 118 may be an annular wall which extends in a ring-like manner around a further central element of the cutting unit 106 (not shown). However, in other arrangements, the central wall portion 118 may be a substantially circular wall portion which forms the central area of the cutting unit 106 surrounded by the inner side wall 117 and the main annular wall 115. In such arrangements, it will be understood that an annular area of the central wall portion 118 adjacent the inner side wall 117 will be an annular recessed area.

In some arrangements, the central wall portion 118 may be concave or partially concave, or convex, or partially convex. In some arrangements the central wall portion 118 may comprise a cap attached to the external cutting member 112 in the central area surrounded by the annular cutting zone 114, such as a domed cap which may encourage hairs towards the main annular wall 115 to be cut. Such a cap may also have a decorative function. However, in such arrangements, it will be understood that the annular recessed area of the central wall portion 118 is maintained adjacent the inner side wall 117. Thus, in any arrangement according to the invention, the central wall portion 118 is recessed relative to the main annular wall 115 at least in the annular recessed area adjacent to the inner side wall 117 of the annular cutting zone 114.

The main annular wall 115 is curved in the radial cross section as shown in FIG. 4. In particular, the main annular wall 115 is convex and protrudes externally. The main annular wall 115 has an external surface 115*a* and an internal surface 115*b*. As discussed, the hair cutting apparatus 100 may be used without the hair guide 200. In this mode of use, the cutting units 106,108,110 may be applied directly to a user's skin, and the external surface 115*a* of the main annular wall 115 of each cutting unit will contact the user's skin in order to achieve that the hairs will be cut as close as possible to the skin surface.

However, in some cases, it may be desirable to leave a longer length of hair intact after cutting. For example, a user may wish to maintain a certain length of hair or hair stubbles. In such cases, the hair guide 200 may be attached to the cutting unit 102.

At the location of each of the hair guiding members 206, 208, 210, the support member 202 of the hair guide 200 has a circular aperture 218 associated with a respective one of the cutting units 106, 108, 110, and into which the respective cutting unit 106, 108, 110 is received, when the hair guide 200 is attached to the cutting head 102. Each of the hair guiding elements 212 has a root portion 216 which is connected to the support member 202 at a periphery of the aperture 218. The external surface of the root portion may be smoothly curved to avoid a sharp edge which may irritate the skin when the hair guide 200 is moved across the skin.

A plurality of hair guiding elements 212 then extend generally radially inward above the aperture 218 to form an annular comb along the periphery of each aperture 218 as can be seen in FIGS. 2 and 3. Each aperture 218 and its respective hair guiding elements 212 form a hair guiding member 206, 208, 210.

When the hair guide 200 is attached to the cutting head 102 as shown in FIG. 4, each of the hair guiding elements 212 is arranged over the main annular wall 115 of the respective cutting unit 106, 108, 110. Thus, the annular hair guiding members 206, 208, 210 are arranged relative to the support member 202 of the hair guide 200 such that, when the support member 202 is coupled to the cutting head 102, the annular hair guiding members 206, 208, 210 are each associated with a respective one of the cutting units 106, 108, 110 such that the plurality of hair guiding elements 212 partially cover the main annular wall 115 of the associated cutting unit. The hair guiding elements 212 have an upper surface 212*a* and a lower surface 212*b*. When the hair guide 200 is coupled to the cutting head 102, a portion of the lower surface 212*b* of the hair guiding element 212 is in contact with the external surface 115*a* of the main annular wall 115 of the associated cutting unit over a radial distance or length D1, which spans a majority of the radial extension of the main annular wall 115 relative to the axis of rotation x. In alternative embodiments, said length D1 of contact between the lower surface 212*b* and the external surface 115*a* may be smaller than said radial extension of the main annular wall 115.

Over this length D1, the lower surface 212*b* is concave to conform to the external surface 115*a* of the main annular wall 115. Of course, in other arrangements, the lower surfaces 212*b* of the hair guiding elements 212 may have a different form to conform with the main annular wall of other shaving systems, which could, for example, be flat or concave. In this example, over the length D1, the upper surface 212*a* of the hair guiding element 212 is substantially planar. However, in other examples, the upper surfaces 212*a* of the hair guiding elements 212 may be formed differently and perform the same function. For example, the upper surface 212*a* could be convex or concave.

In the example of FIG. 4, a depth L of the hair guiding elements 212 in an axial direction relative to the central axis y varies along the length D1. The depth L of the hair guiding element 212 is at a minimum at approximately the midpoint of the length D1, although it should be understood that the minimum depth of the hair guiding element 212 could be in a different location. It should also be understood that, in other examples, the upper and lower surfaces 212*a*, 212*b* of the hair guiding element 212 may be formed differently. For example, the upper and lower surfaces 212*a*, 212*b* could be parallel or complimentarily curved such that the depth L is constant along the distance D1.

In use, with the hair guide 200 coupled to the cutting head 102, it will be understood that the upper surfaces 212*a* of the hair guiding elements 212 contact the user's skin. As the cutting of hairs occurs between the main annular wall 115 and the internal cutting element (not shown), the hair guide 200 thus spaces the positions in which the hairs are cut away from the skin surface by a minimum of the depth L of the hair guiding elements 212. Accordingly, only hairs which are longer than the depth L will be cut when using the hair guide 200, and any hairs which are longer than the depth L will be cut to a minimum length equal to or slightly larger than the depth L. In some arrangements a plurality of different hair guides 200 having hair guiding elements 212 of different depths L may be provided for selective use with the hair cutting apparatus 100, such that the user can trim the hairs to different lengths by changing the hair guide 200. In addition, the spacing between the hair guiding elements 212 in a tangential direction relative to the central axis y is carefully designed to manage skin doming between the hair guiding elements 212. A closer spacing between the hair guiding elements 212 reduces skin doming but also obscures a larger portion of the main annular wall 115 and the hair-entry openings 116 provided therein, which can reduce cutting efficacy. Conversely, if the spacing between hair guiding elements 212 is increased, the main annular wall 115 and the hair-entry openings 116 provided therein are more freely accessible for hairs, but the risk of skin doming between the hair guiding elements 212 is increased, which may cause larger variations in hair length remaining after cutting.

The hair guiding elements 212 further comprise an inwardly directed rounded end portion 220. The rounded end portion 220 is at a radially inner end of the hair guiding element 212 opposite to the root portion 216 and extends over a radial distance D2.

The rounded end portion 220 is arranged at a distance from the central axis y such that, when the hair guide 200 is coupled to the hair cutting apparatus 100, the rounded end portion 220 is positioned at least partially inwardly of the inner side wall 117 of the annular cutting zone 114 of the associated cutting unit in the radial direction relative to the central axis y. Thus, the rounded end portion 220 at least partially overlies the annular recessed area formed by the central wall portion 118 when viewed in plan containing the central axis y.

It should be understood, however, that the areas of the cutting units 106, 108, 110 above the central wall portions 118 are substantially open, i.e. that the central wall portions 118 are not substantially covered by the hair guiding elements 212 of the hair guide 200. This open central area for each of the cutting units 106, 108, 110 allows free access of hairs into the interspaces between the rounded end portions 220 of the hair guiding elements 212 and further into the hair-entry openings 116 provided in the main annular walls 115.

Furthermore, the rounded end portions 220 are also positioned, in an axial direction relative to the central axis y, at a distance D3 from the annular recessed area of the central wall portion 118 adjacent the inner side wall 117 of the associated cutting unit. In other words, in said axial direction the rounded end portion 220 is spaced from the annular recessed area and from the central wall portion 118 by said distance D3. Accordingly, the rounded end portion 220 of each hair guiding element 212 overhangs the annular recessed area and the central wall portion 118 by the distance D3 and protrudes radially inwards from the main annular wall 115 unsupported by any part of the associated cutting unit 106, 108, 110 or the support member 202.

The rounded end portions 220 and, more generally, the hair guiding elements 212 are therefore operable to interact with hairs as the cutting head 102 with the hair guide 200 coupled thereto is moved across the skin. As a result of their specific arrangement overhanging the annular recessed area of the central wall portion 118 as described here before, the rounded end portions 220 both effectively lift and guide the hairs into the gaps between adjacent hair guiding elements 212, and further into the hair entry openings 116 therebetween. Accordingly, as hairs are more effectively lifted and guided into the annular cutting zones 114 of the cutting units 106, 108, 110, the hair cutting apparatus 100 and hair guide 200 provide an improved hair cutting system which can cut hair more efficiently, quickly, and easily.

As a result of the specific arrangement of the rounded end portions 220 overhanging the annular recessed area of the central wall portions 118 of the cutting units 106, 108, 110 as described here before, the cutting units 106, 108, 110 are able to receive hairs more easily in their central areas. Hairs are not masked in these central areas and can be guided from these central areas towards the annular cutting zones 114 when the hair cutting apparatus 100 with the hair guide 200 coupled thereto are moving in any direction relative to the skin and hair growth direction.

As the hair guiding elements 212 extend radially inward and are distributed along the circumference of the cutting unit 106, the hair guiding elements 212 necessarily extend in different directions relative to the skin. This poly-directional arrangement of the hair guiding elements 212 enables the lifting and catching of hairs independent of their hair growth direction. This can be particularly useful for inexperienced users, as the hair cutting apparatus can cut hairs effectively without requiring consistent movement along strokes in the same direction.

The rounded end portions 220 of the hair guiding elements 212 also improve the user's skin comfort when using the hair guide 200. In particular, the rounded end portions 220 may be provided with a hemi-spherically domed end surface such that the rounded end portions 220 have no hard or sharp edges, which might snag on hairs or irritate the user's skin as the hair guiding elements 212 contact the skin and move relative to the skin.

Accordingly, the hair guide 200 according to the invention provides a more comfortable, efficient, and easier hair cutting system which may be useable by less experienced users and by more experienced users alike.

In the preferred embodiment of the hair guide 200 shown in the figures, each of the plurality of hair guiding elements 212 has a rounded end portion 220 as discussed in detail here before. It is noted that, in other embodiments, not all of the plurality of hair guiding elements 212 may have such a rounded end portion 220. For example, some of the hair guiding elements 212 may have a rounded end portion which is arranged at a distance from the central axis y such that, when the hair guide 200 is coupled to the cutting head 102, the rounded end portion is positioned, in the radial direction relative to the central axis y, fully above the main annular wall 115 of the annular cutting zone 114 of the associated cutting unit 106, 108, 110.

Further, although in the preferred embodiment of the hair guide 200 shown in the figures the rounded end portions 220 of all hair guiding elements 212 are arranged at an equal distance from the central axis y of the annular hair guiding member 206, 208, 210, in alternative embodiments the rounded end portions of the hair guiding elements may be arranged at different distances from the central axis y.

Further, although in the preferred embodiment of the hair guide 200 shown in the figures the hair guiding elements 212 are arranged in the annular hair guiding zone 214 with an equal distance between each pair of adjacent hair guiding elements, in alternative embodiments pairs of adjacent hair guiding elements may instead be arranged with different mutual distances.

Further, although in the preferred embodiment of the hair guide 200 shown in the figures the hair guiding elements 212 each have an equal shape and equal dimensions, in alternative embodiments the hair guide may have hair guiding elements that have mutually different shapes or mutually different dimensions.

Further, although in the preferred embodiment of the hair guide 200 shown in the figures the three annular hair guiding members 206, 208, 210 are substantially identical, in alternative embodiments the hair guide may have two or more hair guiding members that are configured in different manners. For example, the hair guiding members may have a different number of hair guiding elements or hair guiding elements of different shapes and sizes, for example to adapt the hair-guiding properties of each individual hair guiding member of the hair guide to the properties of the individual cutting units of the hair cutting apparatus in case the properties of the cutting units are mutually different.

In the embodiment shown in the figures, the hair cutting apparatus 100 comprises three cutting units 106, 108, 110, and the hair guide 200 comprises three hair guiding members 206, 208, 210 which are arranged relative to the support member 202 such that, when the hair guide 200 is coupled to the cutting head 102, each of the three hair guiding members is associated with a respective one of the three cutting units such that the hair guiding elements 212 partially cover the main annular wall 115 of the associated cutting unit. In alternative embodiments the hair guide may comprise a different number of hair guiding members, for example two or four hair guiding members for use together with a hair cutting apparatus having, respectively, two or four cutting units. In other embodiments the hair guide may comprise a number of hair guiding members which is smaller than the number of cutting units of the hair cutting apparatus with which it co-operates. In such embodiments, when the hair guide is coupled to the hair cutting apparatus, not all of the cutting units of the hair cutting apparatus are associated with a hair guiding member of the hair guide, and one or more of the cutting units may for example not be covered by a hair guiding member of the hair guide. In another variant of the hair guide, in at least one of the annular hair guiding members the plurality of hair guiding elements are provided only in a particular angular sector of the hair guiding member, while no hair guiding elements are provided in the remaining angular portion of the hair guiding member.

As further shown in FIG. 4, the annular hair guiding members 206, 208, 210 are each arranged relative to the support member 202 such that, when the hair guide 200 is coupled to the cutting head 102, the root portions 216 of the hair guiding elements 212 partially cover the outer side wall 113 of the annular cutting zone 114 of the associated cutting unit 106, 108, 110. Because the hair-entry openings 116 extend into the outer side wall 113, hairs can also enter the hair-entry openings 116 via the interspaces between the root portions 216 of the hair guiding elements 212. To prevent any skin irritation caused by contact between the skin and the root portions 216 when the hair guide 200 is moved over the skin, the root portions 216 have a comparatively large radius of curvature, seen in the cross section of FIG. 4. Experiments have shown that, in order to maintain sufficient skin comfort, preferably no overhanging or protruding hair lifting elements should be provided at the location of the root portions 216 of the hair guiding elements 212. However, within the scope of the present invention, such hair lifting elements may nevertheless be provided also at the location of the root portions 216 to further increase the cutting efficiency of the hair cutting apparatus 100 when used together with the hair guide 200, but this will generally decrease skin comfort. The inventors surprisingly found no decrease of skin comfort by providing overhanging or protruding hair lifting elements in the form of the rounded end portions 220 provided on the radially inward sides of the hair guiding elements 212 as described in detail here before.

It is clear for the person skilled in the art that different hair cutting apparatuses will have cutting units of different sizes. Such cutting units are well known, so it will be understood how the hair guide according to the invention and the parts and dimensions thereof can be adapted to suit the particular cutting units of different hair cutting apparatuses. Thus, it is appropriate in this instance to define particular features of the hair guide according to the invention with reference to features of the hair cutting apparatus with which it will be associated.

It will be appreciated by those skilled in the art that, although the invention has been described by way of example with reference to one or more examples, it is not limited to the disclosed examples, and alternative examples may be constructed without departing from the scope of the invention as defined by the appended claims.

The invention claimed is:

1. A hair guide configured to be detachably couplable to a hair cutting apparatus, wherein the hair cutting apparatus comprises at least two cutting units each having an external cutting member and an internal cutting member which is rotatable relative to the external cutting member about an axis of rotation, wherein the external cutting member has an annular cutting zone comprising hair-entry openings provided at least in a main annular wall of the cutting zone, said annular cutting zone further comprising an inner side wall which surrounds a central wall portion of the external cutting member, said central wall portion being recessed relative to the main annular wall at least in an annular recessed area adjacent to the inner side wall, said hair guide comprising:

a support member configured to be detachably couplable to the hair cutting apparatus, at least two annular hair guiding members each having a central axis and a plurality of hair guiding elements having a main direction of extension in a radial direction relative to the central axis and arranged in an annular hair guiding zone extending about the central axis, wherein:

the annular hair guiding members are arranged relative to the support member such that, when the support member is coupled to the hair cutting apparatus, each of the at least two annular hair guiding members is associated with a respective one of the at least two cutting units such that the plurality of hair guiding elements partially cover the main annular wall of the associated cutting unit, and at least one of the hair guiding elements has an inwardly directed rounded end portion which is arranged at a distance from the central axis such that, when the support member is coupled to the hair cutting apparatus, the rounded end portion is positioned, in the radial direction relative to the central axis, at least partially inwardly of the inner side wall of the associated cutting unit and, in an axial direction relative to the central axis, at a distance from the annular recessed area of the associated cutting unit.

2. The hair guide according to claim 1, wherein each of the plurality of hair guiding elements has the inwardly directed rounded end portion.

3. The hair guide according to claim 2, wherein the rounded end portions of the hair guiding elements are each arranged at an equal distance from the central axis.

4. The hair guide according to claim 1, wherein the annular cutting zone of the associated cutting unit further comprises an outer side wall which surrounds the main annular wall of the associated cutting unit, and wherein each annular hair guiding member is arranged relative to the support member such that, when the support member is coupled to the hair cutting apparatus, the plurality of hair guiding elements partially cover the outer side wall.

5. The hair guide according to claim 1, wherein the hair guiding elements are configured such that, when the support member is coupled to the hair cutting apparatus, a lower surface of each hair guiding element is in contact with the main annular wall of the associated cutting unit.

6. The hair guide according to claim 5, wherein the hair guiding elements are configured such that, when the support member is coupled to the hair cutting apparatus, a lower surface of each hair guiding element is in contact with the main annular wall of the associated cutting unit over a majority of a radial extension of the main annular wall relative to the axis of rotation.

7. The hair guide according to claim 1, wherein the hair-entry openings of the associated cutting unit have a main direction of extension in a radial direction relative to the axis of rotation, and wherein the hair guiding elements are configured such that, when the support member is coupled to the hair cutting apparatus, the main direction of extension of each hair guiding element is parallel to the main direction of extension of a hair-entry opening adjacent to the respective hair guiding element.

8. The hair guide according to claim 1, wherein the hair guiding elements are arranged in the annular hair guiding zone with an equal distance between each pair of adjacent hair guiding elements.

9. The hair guide according to claim 1, wherein the hair guiding elements each have an equal shape and equal dimensions.

10. The hair guide according to claim 1, wherein each annular hair guiding member is arranged relative to the support member such that, when the support member is coupled to the hair cutting apparatus, the central axis coincides with the axis of rotation of the associated cutting unit.

11. The hair guide according to claim 1, wherein the support member comprises a coupling member configured and arranged to be detachably engaged with an associated coupling member of the hair cutting apparatus.

12. A hair cutting system comprising the hair cutting apparatus and the hair guide according to claim 1.

* * * * *